US007699583B2

(12) United States Patent
Cunha

(10) Patent No.: US 7,699,583 B2
(45) Date of Patent: Apr. 20, 2010

(54) SERPENTINE MICROCIRCUIT VORTEX TURBULATONS FOR BLADE COOLING

(75) Inventor: Francisco J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 679 days.

(21) Appl. No.: 11/491,404

(22) Filed: Jul. 21, 2006

(65) Prior Publication Data

US 2008/0019840 A1 Jan. 24, 2008

(51) Int. Cl.
*F01D 5/18* (2006.01)

(52) U.S. Cl. ..... 416/97 R; 415/115

(58) Field of Classification Search ..... 415/115; 416/96 R, 97 R, 92
See application file for complete search history.

(56) References Cited

U.S. PATENT DOCUMENTS 5,361,828 A 11/1994 Lee et al.
5,538,394 A 7/1996 Inomata et al.
6,071,363 A 6/2000 O'Connor et al.
6,247,896 B1 * 6/2001 Auxier et al. ..... 416/97 R
6,705,831 B2 * 3/2004 Draper ..... 415/115
6,705,836 B2 * 3/2004 Bourriaud et al. ..... 416/97 R
6,932,571 B2 * 8/2005 Cunha et al. ..... 416/97 R
7,097,425 B2 * 8/2006 Cunha et al. ..... 416/97 R
7,186,084 B2 * 3/2007 Bunker et al. ..... 416/96 R

FOREIGN PATENT DOCUMENTS

EP 0 845 580 6/1998
EP 1 445 424 8/2004
EP 1 659 264 5/2006
JP 60135606 A 7/1985
JP 7189603 A 7/1995

* cited by examiner

*Primary Examiner*—Ninh H Nguyen
(74) *Attorney, Agent, or Firm*—Bachman & LaPointe, P.C.

(57) ABSTRACT

A cooling microcircuit for use in a turbine engine component is provided. The cooling microcircuit has at least one leg through which a cooling fluid flows. A plurality of cast vortex generators are positioned within the at least one leg to improve the cooling effectiveness of the cooling microcircuit.

14 Claims, 4 Drawing Sheets

SERPENTINE MICROCIRCUIT VORTEX TURBULATONS FOR BLADE COOLING

BACKGROUND (1) Field of the Invention

The present invention relates to a cooling microcircuit for use in turbine engine components, such as turbine blades, that has a plurality of vortex generators within the legs through which a cooling fluid flows to improve cooling effectiveness.

(2) Prior Art

A typical gas turbine engine arrangement includes at plurality of high pressure turbine blades. In general, cooling flow passes through these blades by means of internal cooling channels that are turbulated with trip strips for enhancing heat transfer inside the blade. The cooling effectiveness of these blades is around 0.50 with a convective efficiency of around 0.40. It should be noted that cooling effectiveness is a dimensionless ratio of metal temperature ranging from zero to unity as the minimum and maximum values. The convective efficiency is also a dimensionless ratio and denotes the ability for heat pick-up by the coolant, with zero and unity denoting no heat pick-up and maximum heat pick-up respectively. The higher these two dimensionless parameters become, the lower the parasitic coolant flow required to cool the high-pressure blade. In other words, if the relative gas peak temperature increases from 2500 degrees Fahrenheit to 2850 degrees Fahrenheit, the blade cooling flow should not increase and if possible, even decrease for turbine efficiency improvements. That objective is extremely difficult to achieve with current cooling technology. In general, for such an increase in gas temperature, the cooling flow would have to increase more than 5% of the engine core flow.

SUMMARY OF THE INVENTION

Accordingly, the present invention relates to a turbine engine component, such as a turbine blade, which has one or more vortex generators within the cooling microcircuits used to cool the component.

In accordance with the present invention, a cooling microcircuit for use in a turbine engine component is provided. The cooling microcircuit broadly comprises at least one leg through which a cooling fluid flows and a plurality of cast vortex generators positioned within the at least one leg.

Further in accordance with the present invention, there is provided a process for forming a refractory metal core for use in forming a cooling microcircuit having vortex generators. The process broadly comprises the steps of providing a refractory metal core material and forming a refractory metal core having a plurality of indentations in the form of the vortex generators.

Other details of the serpentine microcircuits vortex turbulators for blade cooling of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
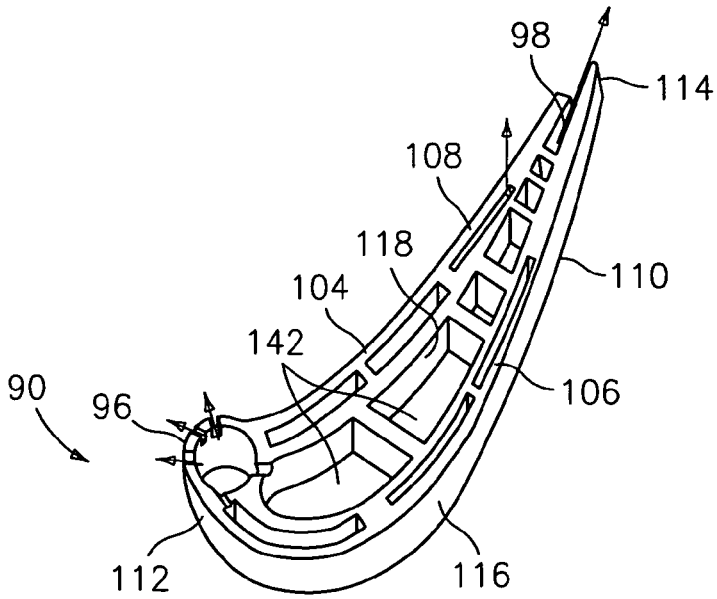
FIG. 1 illustrates a turbine engine component having cooling microcircuits in the pressure and suction side walls.
Figure 2:
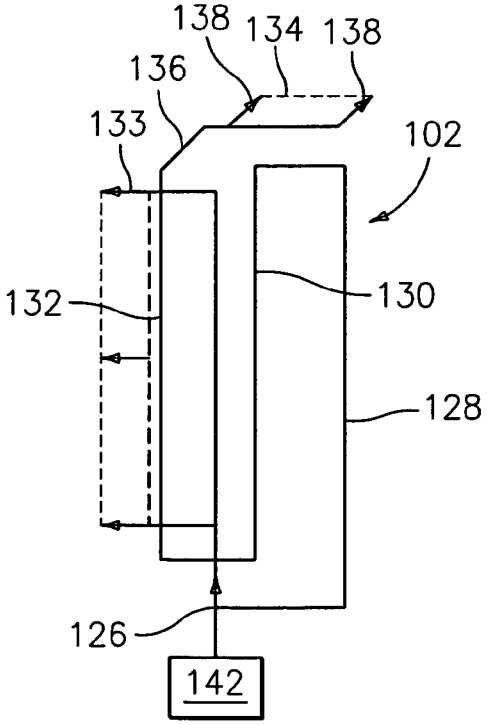
FIG. 2 is a schematic representation of a cooling microcircuit for the suction side of the turbine engine component.
Figure 3:
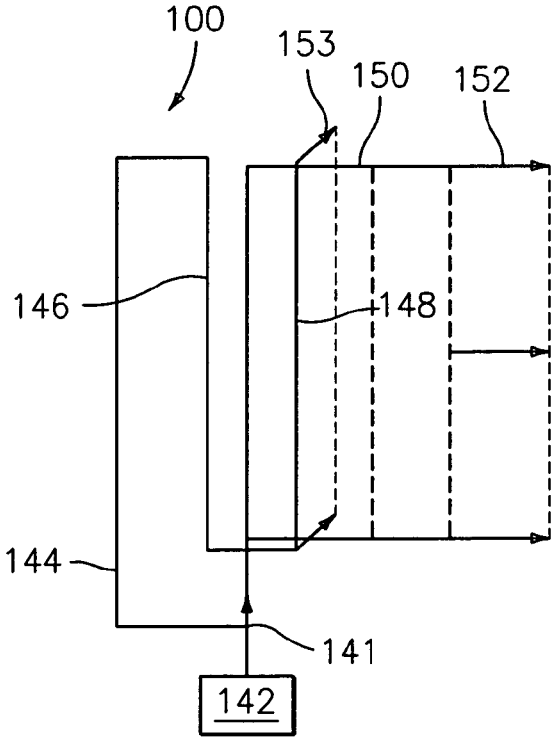
FIG. 3 is a schematic representation of a cooling microcircuit for the pressure side of the turbine engine component.

Referring now to the drawings, FIGS. 1-3 illustrate a serpentine microcircuit cooling arrangement for a turbine engine component, such as a turbine blade. Referring now to the drawings, a turbine engine component 90, such as a high pressure turbine blade, may be cooled using the cooling design scheme shown in FIGS. 1-3. The cooling design scheme, as shown in FIG. 1, encompasses two serpentine microcircuits 100 and 102 located peripherally in the airfoil walls 104 and 106 respectively for cooling the main body 108 of the airfoil portion 110 of the turbine engine component. Separate cooling microcircuits 96 and 98 may be used to cool the leading and trailing edges 112 and 114 respectively of the airfoil main body 108. One of the benefits of the approach of the present invention is that the coolant inside the turbine engine component may be used to feed the leading and trailing edge regions 112 and 114. This is preferably done by isolating the microcircuits 96 and 98 from the external thermal load from either the suction side 116 or the pressure side 118 of the airfoil portion 110. In this way, both impingement jets before the leading and trailing edges become very effective. In the leading and trailing edge cooling microcircuits 96 and 98 respectively, the coolant may be ejected out of the turbine engine component by means of film cooling.

Referring now to FIG. 2, there is shown a serpentine cooling microcircuit 102 that may be used on the suction side 118 of the turbine engine component. As can be seen from this figure, the microcircuit 102 has a fluid inlet 126 for supplying cooling fluid to a first leg 128. The inlet 126 receives the cooling fluid from one of the feed cavities 142 in the turbine engine component. Fluid flowing through the first leg 128 travels to an intermediate leg 130 and from there to an outlet leg 132. Fluid supplied by one of the feed cavities 142 may also be introduced into the cooling microcircuit 96 and used to cool the leading edge 112 of the airfoil portion 110. The cooling circuit 102 may include fluid passageway 131 having fluid outlets 133. Still further, as can be seen, the thermal load to the turbine engine component may not require film cooling from each of the legs that form the serpentine peripheral cooling microcircuit 102. In such an event, the flow of cooling fluid may be allowed to exit from the outlet leg 132 at the tip 134 by means of film blowing from the pressure side 116 to the suction side 118 of the turbine engine component. As shown in FIG. 2, the outlet leg 132 may communicate with a passageway 136 in the tip 134 having fluid outlets 138.

Referring now to FIG. 3, there is shown the serpentine cooling microcircuit 100 for the pressure side 116 of the airfoil portion 110. As can be seen from this figure, the microcircuit 100 has an inlet 141 which communicates with one of the feed cavities 142 and a first leg 144 which receives cooling fluid from the inlet 141. The cooling fluid in the first leg 144 flows through the intermediate leg 146 and through the outlet leg 148. As can be seen, from this figure, fluid from the feed cavity 142 may also be supplied to the trailing edge cooling microcircuit 98. The cooling microcircuit 98 may have a plurality of fluid passageways 150 which have outlets 152 for distributing cooling fluid over the trailing edge 114 of the airfoil portion 110. The outlet leg 148 may have one or more fluid outlets 153 for supplying a film of cooling fluid over the pressure side 116 of the airfoil portion 110 in the region of the trailing edge 114.

It is desirable to increase the convective efficiency of the cooling microcircuits 100 and 102 within the turbine engine component 90 so as to increase the corresponding overall blade effectiveness. To accomplish this increase in convective efficiency, internal features 180 may be placed inside the cooling passages. The existence of the features 180 enable the air inside the cooling microcircuits 100 and 102 to pick-up more heat from the walls of the turbine engine component 90 by increasing the turbulence inside the passages of the cooling microcircuits 100 and 102.

Figure 4A:
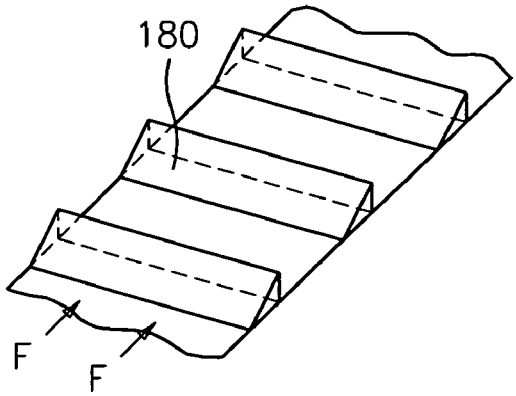
FIG. 4A illustrates a wedge shaped continuous rib type of vortex generator.
Figure 4B:
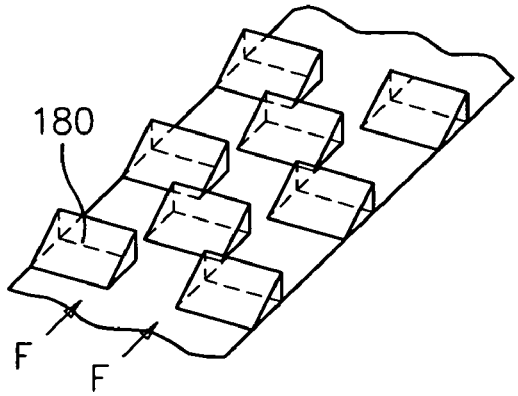
FIG. 4B illustrates a series of wedge shaped broken rib vortex generators.
Figure 4C:
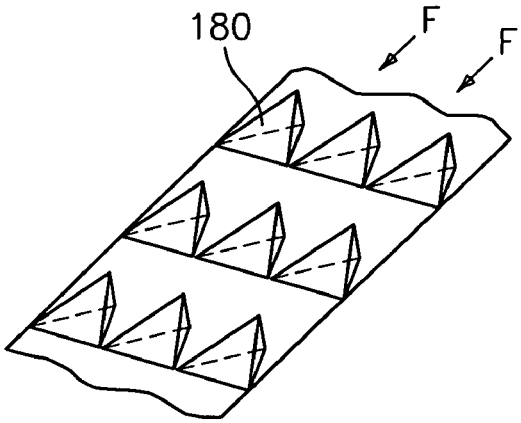
FIG. 4C illustrates a delta-shaped backward aligned rib configuration of vortex generators.
Figure 4D:
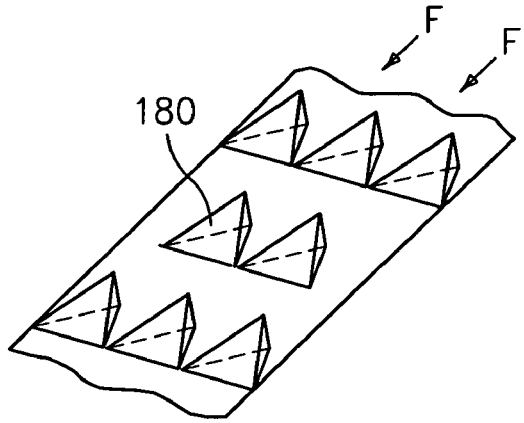
FIG. 4D illustrates a series of wedge shaped backward offset rib vortex generators.

FIGS. 4A-4D illustrate a series of vortex generator features 180 which could be placed in the legs 128, 130, 132, 144, 146, and 148 of the cooling microcircuits 100 and 102 within the turbine engine component 90. FIG. 4A illustrates a wedge shaped continuous rib type of vortex generator. FIG. 4B illustrates a series of wedge shaped broken rib vortex generators. FIG. 4C illustrates a delta-shaped backward aligned rib configuration of vortex generators. FIG. 4D illustrates a series of wedge shaped backward offset rib vortex generators. As the cooling flow F flowing in the respective legs 128, 130, 132, 144, 146, and/or 148 passes over these features, a series of vortices are generated.

Figure 5:
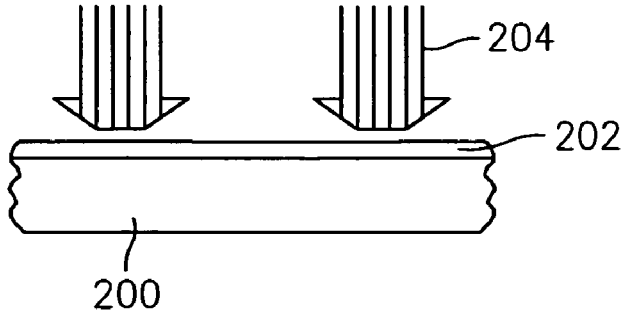
FIGS. 5-7 illustrate a process for forming a refractory metal core.
Figure 6:
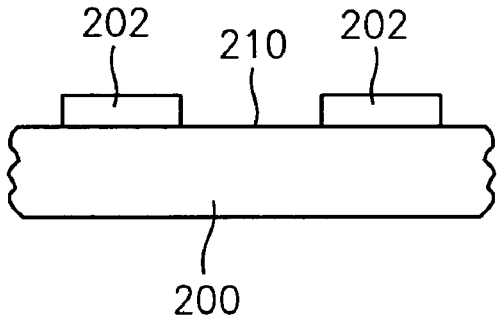
Figure 7:
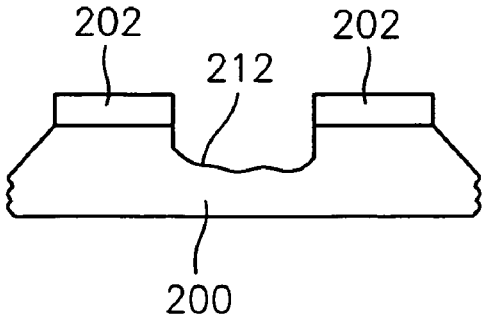

If the legs 128, 130, 132, 144, 146, and 148 of the serpentine cooling microcircuits 100 and 102 are formed using refractory metal cores, a machining operation can be done to place these vortex generators in the core. FIGS. 5-7 illustrate a photo-lithography method of forming these features onto a refractory metal core material 200. The machining process may be done through a chemical etching process. Sufficient material may be taken out of the refractory metal core 200 to form the desired vortex generators/turbulators 180. During an investment casting process, these machined indentations are filled with superalloy material to form the vortex generators 180 within the legs of the cooling microcircuits. The overall process is referred to as a photo-etch process prior to investment casting. The process consists of using the refractory metal core as the core material in an investment casting technique to form the cooling passages with vortex generators in the blade cooling passage. The photo-etch process consists of two sub-processes: (1) the preparation of mask material through the process of photo-lithography; and (2) a subsequent process of chemically attacking the refractory metal core material by etching away as small surface indentions.

As shown in FIG. 5, a layer of polymer film mask material 202 is placed over the refractory metal core 200 and is subjected to UV light 204. The ultraviolet light 204 is programmed to impinge onto the polymer film mask material 202 for curing purposes. As certain designated parts of the polymer film mask material 202 are cured by light, the other surface areas of the polymer film mask material 202 are not affected by the light.

Referring now to FIG. 6, non-cured polymer film material is chemically removed from the area 210, while the cured polymer film material 202 is maintained so as to form a mask.

Referring now to FIG. 7, areas of the refractory metal core material 200 not protected by the mask are attacked by an etching chemical solution through acid dip or spray. The etching process leaves an indentation 212 in the refractory metal core 200 to form a turbulator, such as a trip strip or a vortex generator.

Alternatively, a laser beam can be used to outline the vortex generators in the refractory metal core material 200 with beams that penetrate the refractory metal core substrate 200 to form the desired features shown in FIGS. 4A-4D.

Figure 8:
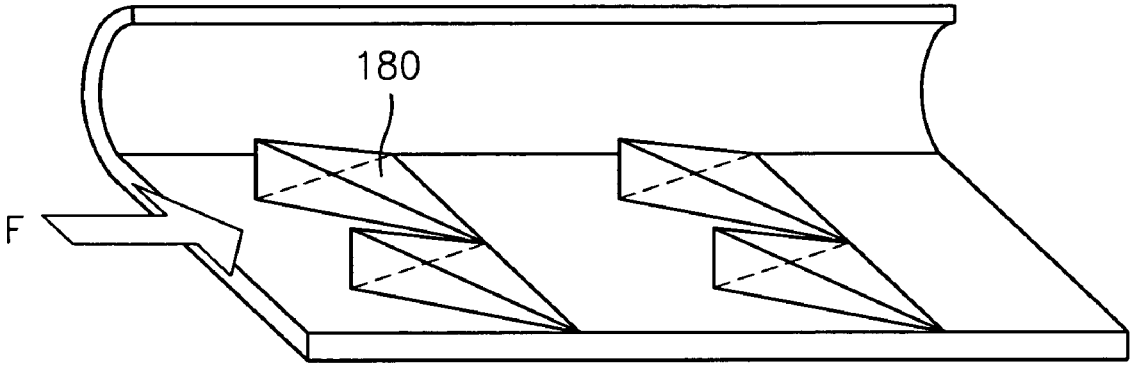
FIG. 8 illustrates a plurality of vortex generators in a cooling microcircuit passage.

FIG. 8 illustrates how the photo-etch process leads to the legs 128, 130, 132, 144, 146, and 148 in the turbine engine component 90 after the casting process. In general, in an investment casting process, a wax pattern leads to the solidification of the superalloy, and the refractory metal core 200, as the core material, leads to the open spaces for the legs of the cooling microcircuits. The refractory metal core 200 is eventually removed through a leaching process. When alloy solidification takes place, the series of vortex generators 180 are placed on the walls of the legs 128, 130, 132, 144, 146, and/or 148 as shown in FIG. 8.

Extending the principle of creating turbulence, several vortex configurations can be designed to create areas of high heat transfer enhancements everywhere in a cooling passage. In terms of the design shown in FIGS. 1-3, both the pressure side and the suction side peripheral serpentine cooling microcircuits may not include film cooling with the exception of the last leg/passage of the serpentine arrangement for the pressure side circuit and for the tip of the suction side serpentine arrangement. Therefore, film cooling may not protect upstream sections of the serpentine cooling design. This is particularly important from a performance standpoint which allows for no mixing of the coolant from film with external hot gases. Since the cooling circuits 100 and 102 are embedded in the walls, their cross sectional area is small and internal features, such as the vortex generators 180 shown in FIGS. 4A-4D, are needed to increase the convective efficiency of the circuits 100 and 102, leading to an overall cooling effectiveness for the turbine engine component 90. Naturally, the cooling flow may be reduced from typical values of 5% core engine flow to about 3.5%.

It is apparent that there has been provided in accordance with the present invention serpentine microcircuits vortex turbulators for blade cooling which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A cooling microcircuit for use in a turbine engine component, said cooling microcircuit comprising:

a serpentine cooling circuit embedded within a wall of said turbine engine component, said serpentine cooling circuit having a plurality of interconnected legs through which a cooling fluid flows;

a plurality of vortex generators positioned within a plurality of said legs for picking up an increased amount of heat from said wall of said turbine engine component by increasing turbulence inside said legs; and each of said vortex generators comprising a wedge shaped generator having a first end and a second end higher than said first end, wherein said serpentine cooling circuit has an inlet leg, an intermediate leg connected to said inlet leg, and an outlet leg connected to said intermediate leg and said outlet leg has at least one fluid outlet for distributing cooling fluid over a portion of said turbine engine component, and wherein said outlet leg has at least one fluid outlet for blowing cooling fluid over a tip of said turbine engine component from a pressure side of said turbine engine component to a suction side of said turbine engine component.

2. The cooling microcircuit of claim 1, wherein said vortex generators are cast structures.

3. The cooling microcircuit of claim 1, wherein said plurality of vortex generators comprises a plurality of wedge shaped continuous rib type vortex generators.

4. The cooling microcircuit of claim 1, wherein said plurality of vortex generators comprises a plurality of wedge shaped broken rib vortex generators.

5. The cooling microcircuit of claim 1, wherein said plurality of vortex generators comprises a plurality of delta-shaped backward aligned rib configuration vortex generators.

6. The cooling microcircuit of claim 1, wherein said plurality of vortex generators comprises a plurality of wedge shaped backward offset rib vortex generators.

7. A turbine engine component having an airfoil portion with a pressure side and a suction side and at least one cooling microcircuit embedded within at least one wall of said pressure side and said suction side, each said cooling microcircuit comprising a serpentine cooling circuit embedded within a wall of said turbine engine component, said serpentine cooling circuit having a plurality of interconnected legs through which a cooling fluid flows; a plurality of vortex generators positioned within a plurality of said legs for picking up an increased amount of heat from said wall of said turbine engine component by increasing turbulence inside said legs; and each of said vortex generators comprising a wedge shaped generator having a first end and a second end higher than said first end, wherein said serpentine cooling circuit has an inlet leg, an intermediate leg connected to said inlet leg, and an outlet leg connected to said intermediate leg and said outlet leg has at least one fluid outlet for distributing cooling fluid over a portion of said turbine engine component and wherein said serpentine cooling circuit is located within said suction side wall, said inlet leg receives said cooling fluid from a feed cavity in the turbine engine component, and said at least one fluid outlet comprises a fluid passageway in a tip of said airfoil portion having at least one fluid outlet so that cooling fluid exits from said outlet leg at the tip by means of film blowing from the pressure side to the suction side of the airfoil portion.

8. The turbine engine component of claim 7, wherein said plurality of vortex generators comprises a plurality of wedge shaped continuous rib type vortex generators.

9. The turbine engine component of claim 7, wherein said plurality of vortex generators comprises a plurality of wedge shaped broken rib vortex generators.

10. The turbine engine component of claim 7, wherein said plurality of vortex generators comprises a plurality of delta-shaped backward aligned rib configuration vortex generators.

11. The turbine engine component of claim 7, wherein said plurality of vortex generators comprises a plurality of wedge shaped backward offset rib vortex generators.

12. The turbine engine component of claim 7, further comprising cooling fluid being supplied from said feed cavity to a leading edge cooling microcircuit.

13. The turbine engine component of claim 7, wherein another serpentine cooling circuit is located with said pressure side wall, said inlet leg receives said cooling fluid from a feed cavity in the turbine engine component, and said at least one fluid outlet comprises at least one fluid outlet for supplying a film of cooling fluid over the pressure side of the airfoil portion in a trailing edge region of said airfoil portion.

14. The turbine engine component of claim 13, further comprising supplying cooling fluid from said feed cavity to a trailing edge cooling microcircuit.

* * * * *